US011352841B2

(12) United States Patent
Dykstra et al.

(10) Patent No.: US 11,352,841 B2
(45) Date of Patent: Jun. 7, 2022

(54) BOTTOMHOLE ASSEMBLY (BHA) STABILIZER OR REAMER POSITION ADJUSTMENT METHODS AND SYSTEMS EMPLOYING A COST FUNCTION

(71) Applicant: Halliburton Energy Services, Inc., Houston, TX (US)

(72) Inventors: Jason D. Dykstra, Spring, TX (US); Xingyong Song, Houston, TX (US); Venkata Madhukanth Vadali, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 246 days.

(21) Appl. No.: 16/330,536

(22) PCT Filed: Dec. 8, 2016

(86) PCT No.: PCT/US2016/065664

§ 371 (c)(1),
(2) Date: Mar. 5, 2019

(87) PCT Pub. No.: WO2018/106248

PCT Pub. Date: Jun. 14, 2018

(65) Prior Publication Data

US 2021/0277726 A1 Sep. 9, 2021

(51) Int. Cl.
*E21B 17/10* (2006.01)
*E21B 10/30* (2006.01)

(52) U.S. Cl.
CPC ..... *E21B 17/1078* (2013.01); *E21B 10/30* (2013.01); *E21B 17/10* (2013.01)

(58) Field of Classification Search
CPC ..... E21B 17/10; E21B 17/1078; E21B 10/30
See application file for complete search history.

(56) References Cited

U.S. PATENT DOCUMENTS

| | | | | |
|---|---|---|---|---|
| 4,491,187 | A | 1/1985 | Russell | |
| 4,848,490 | A | 7/1989 | Anderson | |
| 8,448,722 | B2 | 5/2013 | Konschuh et al. | |
| 9,500,034 | B2 * | 11/2016 | Holtz | E21B 7/067 |
| 2008/0169107 | A1 * | 7/2008 | Redlinger | E21B 17/1014 166/382 |
| 2011/0005836 | A1 * | 1/2011 | Radford | E21B 10/32 175/57 |
| 2011/0031023 | A1 | 2/2011 | Menezes et al. | |
| 2013/0282342 | A1 | 10/2013 | Bailey et al. | |
| 2014/0251687 | A1 | 9/2014 | McKay | |
| 2015/0322767 | A1 | 11/2015 | Samuel | |
| 2018/0179831 | A1 * | 6/2018 | Spatz | E21B 7/067 |

FOREIGN PATENT DOCUMENTS

| | | | |
|---|---|---|---|
| WO | 2014138045 | A1 | 9/2014 |
| WO | 2018106248 | A1 | 6/2018 |

* cited by examiner

*Primary Examiner* — Yong-Suk (Philip) Ro
(74) *Attorney, Agent, or Firm* — Benjamin Ford; Parker Justiss, P.C.

(57) ABSTRACT

A system that includes a drillstring with a bottomhole assembly (BHA). The system also includes at least one stabilizer or reamer integrated with the BHA, wherein each of the at least one stabilizer or reamer includes a position adjustment assembly. The system also includes a processing unit that provides control signals to each position adjustment assembly, wherein the control signals are based on a cost function.

20 Claims, 5 Drawing Sheets

BOTTOMHOLE ASSEMBLY (BHA) STABILIZER OR REAMER POSITION ADJUSTMENT METHODS AND SYSTEMS EMPLOYING A COST FUNCTION

CROSS-REFERENCE TO RELATED APPLICATION

This application is the National Stage of, and therefore claims the benefit of, International Application No. PCT/US2016/065664 filed on Dec. 8, 2016, entitled "BOTTOMHOLE ASSEMBLY (BHA) STABILIZER OR REAMER POSITION ADJUSTMENT METHODS AND SYSTEMS EMPLOYING A COST FUNCTION," which was published in English under International Publication Number WO 2018/106248 on Jun. 14, 2018. The above application is commonly assigned with this National Stage application and is incorporated herein by reference in its entirety.

BACKGROUND

Hydrocarbon exploration and production involves drilling boreholes, where different boreholes can be used for exploration operations, monitoring operations, injection operations, and production operations. The process of drilling boreholes is expensive and a poorly drilled borehole can increase the cost of subsequent operations (e.g., well completion and/or production operations). In some cases, a poorly drilled borehole can result in the borehole being unsuitable for production. In such case, the poorly drilled borehole may need to be plugged and a replacement borehole may be needed.

Efforts to improve hydrocarbon exploration and production operations are ongoing. One category of such efforts involves increasing the efficiency of drilling operations and/or improving borehole trajectories/profiles. To this end, bottomhole assemblies (BHAs) have included stabilizers and/or reamers. The position of stabilizers and/or reamers on a BHA can affect system vibration, stick slip, bit wear, stabilizer or reamer water, cutting loading, rate of penetration (ROP) and/or other drilling issues. Unfortunately, a fixed position for stabilizers and/or reamers does not always optimize drilling. Also, proposals to adjust the position of stabilizers and/or reamers often do not account for changing conditions downhole, resulting in sub-optimal drilling.

BRIEF DESCRIPTION OF THE DRAWINGS

Accordingly, there are disclosed herein bottomhole assembly (BHA) stabilizer or reamer position adjustment methods and systems employing a cost function. In the drawings.

Figure 1:
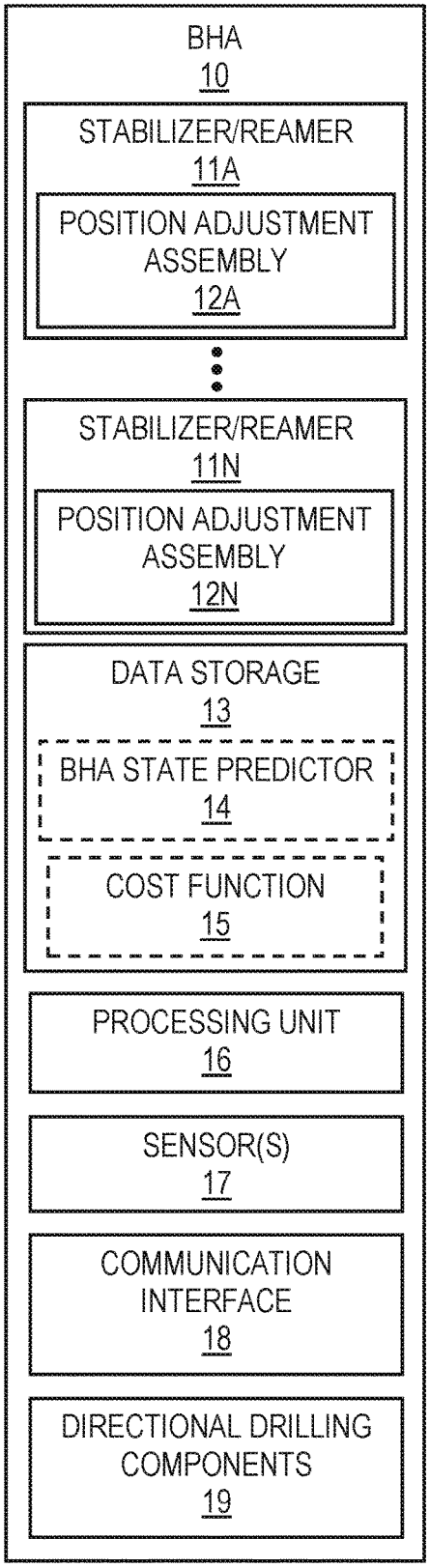
FIG. 1 is a block diagram showing an illustrative BHA.

It should be understood, however, that the specific embodiments given in the drawings and detailed description below do not limit the disclosure. On the contrary, they provide the foundation for one of ordinary skill to discern the alternative forms, equivalents, and other modifications that are encompassed in the scope of the appended claims.

DETAILED DESCRIPTION

Disclosed herein are bottomhole assembly (BHA) stabilizer or reamer position adjustment methods and systems employing a cost function. In different embodiments, a BHA may include one stabilizer or reamer, or may include a plurality of stabilizers or reamers. For each stabilizer or reamer, a position adjustment assembly is provided. Each position adjustment assembly may support movement of a single stabilizer or reamer, or may support movement of multiple stabilizer or reamers. Axial, radial, or rotational movement of each stabilizer or reamer is possible.

To control each position adjustment assembly, control signals are needed. In at least some embodiments, the control signals are provided by at least one processing unit in communication with each position adjustment assembly. The at least one processing unit may be located downhole (e.g., in the BHA) or at earth's surface. In different embodiments, some of the processing performed to provide the control signals occurs downhole while other portions of the processing performed to provide the control signals occurs at earth's surface.

In at least some embodiments, the control signals for each position adjustment assembly are based on a cost function that accounts for predicted BHA states and a position range for each stabilizer or reamer. The predicted BHA states are obtained, for example, using a dynamic system model. The dynamic system model can include linear functions and/or non-linear functions that account for BHA component dynamics, borehole fluid dynamics, drill bit dynamics, and/or other system components. The BHA component dynamics may comprise separate functions for BHA finite element beam dynamics and stabilizer/reamer component dynamics. As desired, the dynamic system model may also include an uncertainty term. Regardless of the particular functions or terms used, the dynamic system model can estimate a system state with values for various system components at each of multiple time steps. The system state or part of the system state at multiple time steps is used as the predicted BHA states.

In at least some embodiments, control signals for each position adjustment assembly are provided, at least in part, using a cost function that accounts for predicted BHA states and a position range for each stabilizer or reamer. The predicted BHA states may be accounted for in the cost function by using a stabilizer/reamer position term in the cost function, where values for the stabilizer/reamer position term are obtained from the predicted BHA states. The cost function may also include terms such as a BHA vibration magnitude term, a drill bit wear term, a trajectory error term, an uncertainty term, a stabilizer/reamer wear term, and a wellbore tortuosity term. As desired, weights can be applied to different terms of the cost function. In this manner, drilling operations can be optimized for a particular goal or scenario (e.g., to minimize drilling vibration, to minimize the position adjustment for a stabilizer or reamer, to minimize the trajectory error, to minimize drill bit wear, to minimize stabilizer or reamer wear, to minimize wellbore tortuosity, etc.). In different embodiments, the cost function can be applied to a time-domain optimization problem or a frequency-domain optimization problem (loop shaping control) to select control signals for each position adjustment assembly. As desired, the BHA state prediction process and the generation of control signals position adjustment assemblies can be repeated over time.

In at least some embodiments, an example system includes a drillstring with a BHA and at least one stabilizer or reamer integrated with the BHA. Each of the at least one stabilizer or reamer includes a position adjustment assembly. The system also includes a processing unit that provides control signals to each position adjustment assembly, wherein the control signals are based on a cost function. Meanwhile, an example method includes deploying a drillstring in a borehole, the drillstring having a BHA with at least one stabilizer or reamer, and each stabilizer or reamer having a position adjustment assembly. The method also includes generating, by the processing unit, control signals for each position adjustment assembly based on a cost function. The method also includes adjusting, by at least one position adjustment assembly, a position of each respective stabilizer or reamer in response to the control signals. Various BHA stabilizer or reamer position adjustment options and control options are disclosed herein.

The disclosed systems and methods are best understood when described in an illustrative usage context. FIG. 1 shows an illustrative BHA 10. The BHA 10 includes a plurality of stabilizers or reamers 11A-11N (an embodiment with one stabilizer or reamer is possible as well). Each of the stabilizers or reamers 11A-11N includes a respective position adjustment assembly 12A-12N. In alternative embodiments, some of stabilizers or reamers 11A-11N may share some or all components of a position adjustment assembly. In such case, stabilizers or reamers 11A-11N can be moved together or separately.

Without limitation, each of the stabilizers or reamers 11A-11N may be of the same material, size, and shape. Alternatively, some of the stabilizers or reamers 11A-11N may vary with regard to material, size, and/or shape. Since the stabilizers or reamers 11A-11N are used in a drilling environment, a suitable material may be steel. Stabilizers are used to adjust the points of contact between the BHA and the borehole wall during the drilling process. Such points of contact can improve the drilling process by reducing the occurrence of drilling vibration, stick slip, cutting loading, and/or other drilling issues. Such drilling issues are dynamic due to drillstring changes, drilling control parameters changes, environmental changes, and downhole formation changes. Meanwhile, reamers along the BHA can be used to improve uniformity or smoothness of the borehole shape after a drill bit has passed.

As desired, the position of the stabilizers or reamers 11A-11N can be adjusted together or independently by the position adjustment assemblies 12A-12N. For each adjustment interval, the position of the stabilizers or reamers 11A-11N may stay the same, one of the stabilizers or reamers 11A-11N can be adjusted, or a plurality of the stabilizers or reamers 11A-11N can be adjusted. The adjustment interval can be selected based on various factors including, but not limited to, the position range of the stabilizers or reamers 11A-11N, timing constraints of position adjustment calculations, timing constraints of position adjustment assembly components.

Each of the position adjustment assemblies 12A-12N may include the same components or different components. Example components for a position adjustment assembly include, but are not limited to, lock/unlock components, proportional valves, actuators, rollers, and sliding tracks. Hydraulic actuators, electrical actuators, and/or pneumatic actuators that provide linear or rotational motion are possible. Such components can provide axial movement, radial movement, or rotational movement for a stabilizer or reamer.

In at least some embodiments, a processing unit 16 of the BHA 10 provides control signals to components of the position adjustment assemblies 12A-12N based at least in part on predicted BHA states and a cost function 15. For example, the BHA 10 may include a data storage 13 with a BHA state predictor 14 and the cost function 15. In at least some embodiments, the data storage 13 comprises a computer-readable medium such as random-access memory (RAM) or read-only memory (ROM). Meanwhile, the processing unit 16 may correspond to a central processing unit (CPU), programmable logic, or an application-specific integrated circuit (ASIC). Rules or instructions for adjusting the BHA state predictor 14 and/or the cost function 15 may also be included with the data storage 13. When executed by the processing unit 16, instructions corresponding to the BHA state predictor 14 and the cost function 15 cause the processing unit 16 to perform various operations, resulting in control signals for components of the position adjustment assemblies 12A-12N.

In at least some embodiments, the BHA state predictor 14 predicts BHA states using a dynamic system model. The dynamic system model can include linear functions and/or non-linear functions that account for BHA component dynamics, borehole fluid dynamics, drill bit dynamics, and/or other system components. The BHA component dynamics may comprise separate functions for BHA finite element beam dynamics and stabilizer/reamer component dynamics. As desired, the dynamic system model may also include an uncertainty term. Regardless of the particular functions or terms used, the dynamic system model can estimate a system state with values for various system components at each of multiple time steps. The system state or part of the system state at multiple time steps is used as the predicted BHA states.

The cost function 15 accounts for the predicted BHA states and a position range for each stabilizer or reamer. For example, the predicted BHA states may be accounted for in the cost function 15 by using a stabilizer/reamer position term in the cost function, where values for the stabilizer/reamer position term are obtained from the predicted BHA states. The cost function 15 may also include terms such as a BHA vibration magnitude term, a drill bit wear term, a trajectory error term, an uncertainty term, a stabilizer/reamer wear term, and a wellbore tortuosity term. As desired, weights can be applied to different terms of the cost function 15. In this manner, drilling operations can be optimized for a particular goal or scenario (e.g., to minimize drilling vibration, to minimize the position adjustment for a stabilizer or reamer, to minimize the trajectory error, to minimize drill bit wear, to minimize stabilizer or reamer wear, to minimize wellbore tortuosity, etc.). In different embodiments, the cost function 15 can be applied to a time-domain optimization problem or a frequency-domain optimization problem (loop shaping control) to select control signals for each of the position adjustment assemblies 12A-12N. As desired, the processing unit 16 can repeat the BHA state prediction process and the cost function process to generate control signals for the position adjustment assemblies 12A-12N over time.

In an alternative embodiment, predetermined predicted BHA states and/or cost function results are stored by the data storage 13 for use by the processing unit 16 to provide control signals for components of the position adjustment assemblies 12A-12N. As an option, look-up tables (LUTs) of stored information related to predetermined predicted BHA states and/or cost function results can be used by the processing unit 16. In yet another alternative embodiment, the processing unit 16 may receive real-time predicted BHA states and/or cost function results from another source such as a computer at earth's surface. In such case, downlink telemetry can be used to convey the predicted BHA states and/or cost function results to the processing unit 16. Depending on the amount of information that needs to be conveyed, telemetry options may include mud pulse telemetry, acoustic telemetry, electromagnetic signal telemetry, wired telemetry (e.g., using wired pipe), and/or other telemetry options. Any telemetry options for the BHA 10 are represented by the communication interface 18, and uplink telemetry can be supported as well as downhole telemetry. For example, uplink telemetry operations may be used to convey measurements from sensor(s) 17 to earth's surface. Example measurements include formation measurements (logging-while-drilling measurements), BHA state measurements, environment measurements, and/or other measurements. Additionally or alternatively, predicted BHA states and/or cost function results can be conveyed to earth's surface using the communication interface 18.

Additionally or alternatively to being transmitted to earth's surface, at least some measurements from sensor(s) 17 are stored by the data storage 13 for use by the processing unit 16 in providing control signals to the position adjustment assemblies 12A-12N. For example, measurements from sensor(s) 17 may be used to update measured BHA state values that go into the dynamic system model employed by the BHA state predictor 14 to predict future BHA states. Additionally or alternatively, at least some measurements from sensor(s) 17 may be used to update terms or term values of the cost function 15.

In conjunction with operations performed by the stabilizers or reamers 11A-11N, directional drilling components 19 operate to extend a borehole in a straight line or curved line. Known, measured, or estimated attributes of the directional drilling components 19 can be used in the dynamic system model employed by the BHA state predictor 14 to predict future BHA states or in the cost function 15 used to provide control signals for position adjustment assemblies 12A-12N. Further, various surface components/operations (to vary rotation of the drillstring, to vary the weight applied to the drillstring, to vary drilling mud properties, etc.) can be accounted for in the dynamic system model of the BHA state predictor 14 or in the cost function 15. Without limitation, an example dynamic system model and an example cost function are included hereafter.

Figure 2:
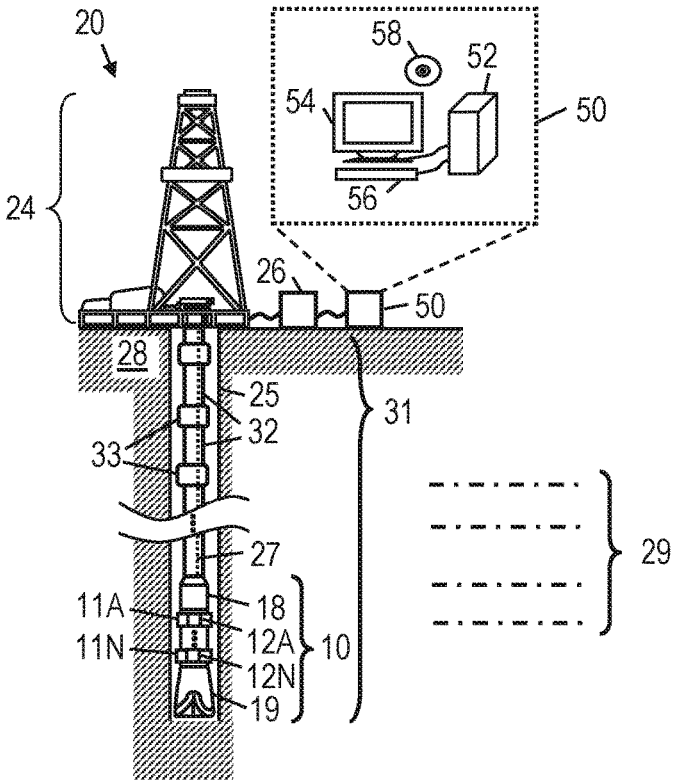
FIG. 2 is a schematic diagram showing an illustrative drilling environment.

FIG. 2 shows an illustrative drilling environment 20. In FIG. 2, a drilling assembly 24 enables a drillstring 31 to be lowered and raised in a borehole 25 that penetrates formations 29 of the earth 28. The drillstring 31 is formed, for example, from a modular set of drillstring segments 32 and adaptors 33. At the lower end of the drillstring 31, a BHA 10 with directional drilling components 19 (e.g., a drill bit and steering components) removes material from the formations 29 using known drilling techniques. The BHA 10 also includes stabilizers or reamers 11A-11N with respective position adjustment assemblies 12A-12N. Also, a communication interface 18 may be provided with the BHA 10 to support uplink and/or downlink telemetry as described for FIG. 1. The BHA 10 may also include other components as described for FIG. 1. For example, the BHA 10 may include components for adjusting the position of the stabilizers or reamers 11A-11N and/or for other operations as described for FIG. 1.

In at least some embodiments, adjusting the position of the stabilizers or reamers 11A-11N can be performed using downhole controllers (e.g., processing unit 16). Additionally or alternatively, surface controllers may be used. In some embodiments, surface controllers may supplement the operations of downhole controllers (e.g., additional information may be provided continuously or periodically depending on the telemetry options available). The result of downhole controller operations and/or surface controller operations is that control signals are dynamically provided to components of the position adjustment assemblies 12A-12N to adjust the position of stabilizers or reamers 11A-11N over time based on predicted BHA states and a cost function as described herein. Example telemetry options that may be employed during this process include, but are not limited to, wired telemetry, mud pulse telemetry, acoustic telemetry, and/or wireless electromagnetic telemetry. In at least some embodiments, a cable 27 may extend from the BHA 10 to earth's surface. For example, the cable 27 may take different forms such as embedded electrical conductors and/or optical waveguides (e.g., fibers) to enable transfer of power and/or communications between the BHA 10 and earth's surface. In other words, the cable 27 may be integrated with, attached to, or inside the modular components of the drillstring 31.

In FIG. 2, an interface 26 at earth's surface may send downlink telemetry signals to the BHA 10 or receive uplink telemetry signals from the BHA 10. A computer system 50 in communication with the interface 26 may perform various operations to directly or indirectly provide control signals for the position adjustment assemblies 12A-12N. In at least some embodiments, the computer system 50 includes a processing unit 52 that performs stabilizer/reamer position adjustment operations by executing software or instructions obtained from a local or remote non-transitory computer-readable medium 58. The computer system 50 also may include input device(s) 56 (e.g., a keyboard, mouse, touchpad, etc.) and output device(s) 54 (e.g., a monitor, printer, etc.). Such input device(s) 56 and/or output device(s) 54 provide a user interface that enables an operator to interact with the BHA 10 and/or software executed by the processing unit 52. For example, the computer system 50 may enable an operator to select stabilizer/reamer position adjustment options, to select directional drilling options, to monitor stabilizer/reamer position adjustment results, and/or to monitor directional drilling results.

Figure 3A:
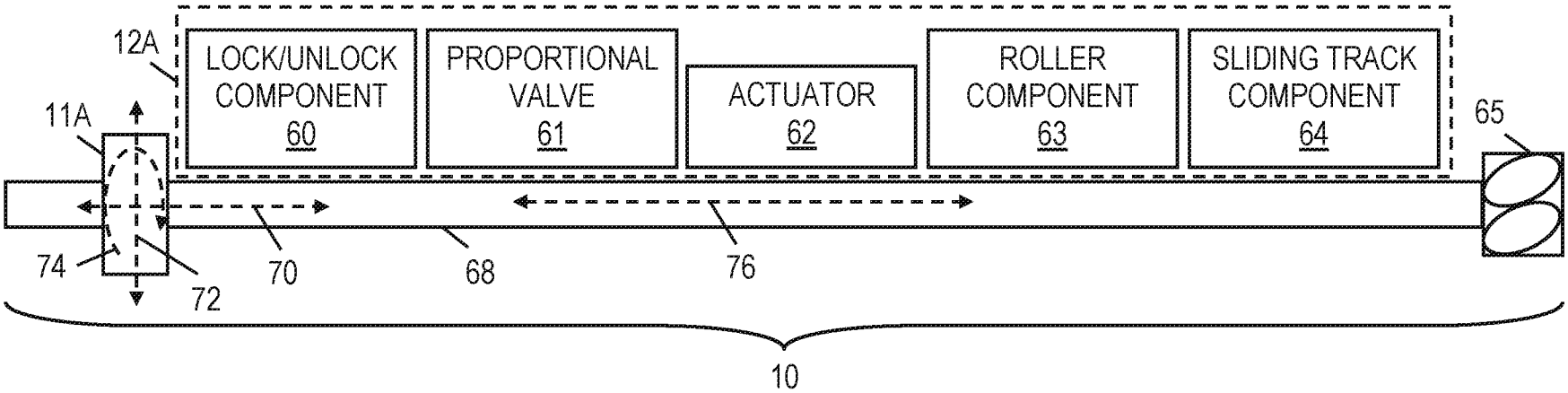
FIG. 3A is a schematic diagram showing illustrative BHA components.

FIG. 3A is a schematic diagram showing illustrative BHA components. In FIG. 3A, the stabilizer or reamer 11A and the position adjustment assembly 12A are represented. The stabilizer or reamer 11A is spaced from a drill bit 65 of the BHA 10 and is integrated with a tool body 68 of the BHA 10. Without limitation to other embodiments, the position adjustment assembly 12A includes a lock/unlock component 60, a proportional valve 61, an actuator 62, a roller component 63, and/or a sliding track component 64. In other embodiments, the position adjustment assembly 12A includes additional components or fewer components. For example, in some embodiments, the actuator 62 can be omitted (e.g., movement of a drillstring and contact of an unlocked stabilizer or reamer 11A with a borehole wall can be used to move the stabilizer or reamer 11A without using an actuator 62). In such embodiments, control signals for the position adjustment assembly 12 are used to direct the lock/unlock component 60 as appropriate. In addition, control signals for downhole or surface directional drilling components are needed to move the drillstring. As another example, if the position adjustment assembly 12A includes the roller component 63, then the sliding track component may be omitted or vice versa. As another example, the position adjustment assembly 12A may include a plurality of one or more of the components represented (multiple lock/unlock components 60, multiple proportional valves 61, multiple actuators 62, multiple roller components 63, and/or multiple sliding track components 64).

In one example embodiment, the position adjustment assembly 12A enables the stabilizer or reamer 11A to move only in an axial direction 70 parallel to a longitudinal BHA axis 76 (e.g., closer to or further from the drill bit 65). In another embodiment, the position adjustment assembly 12A enables the stabilizer or reamer 11A to move only in a radial direction 72 (perpendicular to the longitudinal BHA axis 76). The radial direction may be in one direction (to extend a profile of the stabilizer or reamer 11A in one direction) or in all directions perpendicular to the longitudinal BHA axis 76 (to increase an outer diameter of the stabilizer or reamer 11A). In another embodiment, the position adjustment assembly 12A enables the stabilizer or reamer 11A to move only in a rotational direction 74 (around the longitudinal BHA axis 76). In another embodiment, the position adjustment assembly 12A enables the stabilizer or reamer 11A to move in an axial direction 70, radial direction 72, and/or rotational direction 74 relative to the longitudinal BHA axis 76. While one stabilizer or reamer 11A is represented in FIG. 3A, it should be appreciated that a BHA 10 can include a plurality of stabilizers or reamers 11A-11N, and that each of the stabilizers or reamers 11A-11N can have different position ranges and different directions of movement available.

Figure 3D:
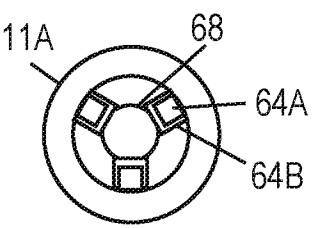
FIGS. 3B-3D are cross-sectional diagrams showing illustrative BHA components.
Figure 3C:
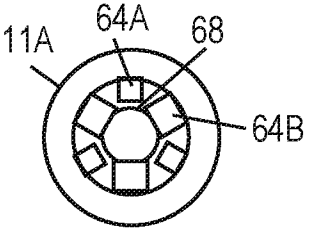
Figure 3B:
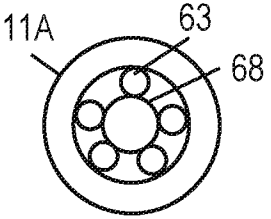

FIGS. 3B-3D are cross-sectional diagrams showing illustrative BHA components. In FIG. 3B, the stabilizer or reamer 11A is represented relative to the tool body 68 of BHA 10. Between the tool body 68 and the stabilizer or reamer 11A, there are roller components 63 that facilitate movement of the stabilizer or reamer 11A in the axial direction 70 described for FIG. 3A. In FIG. 3C, the stabilizer or reamer 11A is again represented relative to the tool body 68 of BHA 10. Between the tool body 68 and the stabilizer or reamer 11A, there are sliding track components 64A and 64B that facilitate movement of the stabilizer or reamer 11A in the axial direction 70 described for FIG. 3A. FIG. 3C shows the sliding track components 64A and 64B when they are azimuthally offset. The scenario of FIG. 3C may occur, for example, when the stabilizer or reamer 11A is in a locked state (movement of the stabilizer or reamer 11A in the axial direction 70 is difficult or not available). Meanwhile, FIG. 3D shows the sliding track components 64A and 64B when they are azimuthally aligned. When the sliding track components 64A and 64B are azimuthally aligned, movement of the stabilizer or reamer 11A in the axial direction 70 is facilitated or available. The scenario of FIG. 3D may occur, for example, when the stabilizer or reamer 11A is in an unlocked state.

Figure 4:
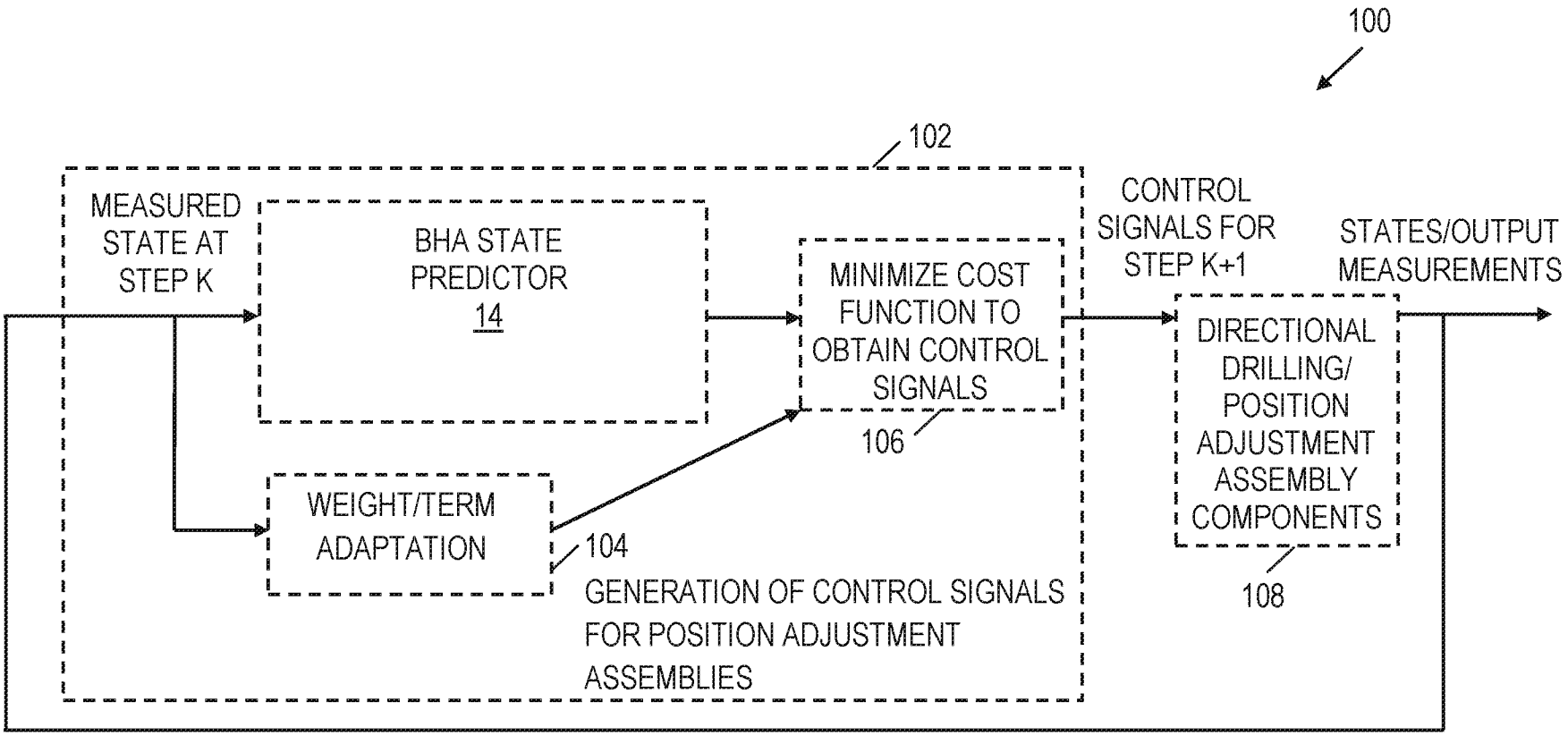
FIG. 4 is a block diagram showing an illustrative technique for generating control signals to adjust position of a stabilizer or reamer.

FIG. 4 is a block diagram showing an illustrative position control technique 100 for one or more position adjustment assemblies (e.g., position adjustment assemblies 12A-12N). In some embodiments, the different steps represented in the position control technique 100 may be performed downhole. Additionally or alternatively, at least some of the steps represented in the position control technique 100 may be performed at earth's surface. At block 102, generation of control signals for position adjustment assemblies is performed. The operations of block 102 include, for example, the BHA state predictor 14 receiving measured state information at step K. The measured state information may include, for example, some or all available measurements regarding BHA components, directional drilling components, and the environment. The BHA state predictor 14 uses the measured state information for step K and a dynamic system model to predict BHA states. The output of the BHA state predictor 14 is provided to processing block 106, where a cost function is minimized to obtain control signals for step K+1. As desired, adaptation operations to update weight or terms of the cost function are performed at block 104. The adaptation operations of block 104 can be based on user input and/or based on predetermined or dynamic rules.

The control signals determined by processing block 106 are provided to directional drilling components (downhole or at earth's surface) and position adjustment assembly components (e.g., components of position adjustment assemblies 12A-12N) at block 108. After block 102, measurements or outputs regarding BHA components, directional drilling components, and the environment can be provided as a measured state for the next step. As desired, the position control technique 100 can be repeated over time to determine control signals for position adjustment assembly components at different time steps.

In at least some embodiments, the position control technique 100 involves solving an optimization problem that minimizes a cost function that accounts for predicted BHA states and a movement range of one or more stabilizers or actuators. For cost function may be selected to constrain BHA vibration and achieve a desired drilling performance. The position control technique 100 may be coordinated other controllers that operate during drilling operations (e.g., BHA controllers, downhole or surface directional drilling controllers, drilling mud flow controller). As desired, the position control technique 100 may involve one or more control options such as robust control, adaptive control, and learning algorithms.

In at least some embodiments, the position control technique 100 uses predicted dynamic states related to drilling and/or the BHA. Example dynamic state include, but are not limited to, the BHA rotational speed, drill bit vibration magnitude, BHA lateral displacement, etc. As desired, the dynamic states may be predicted using a real-time estimator and a threshold amount of prediction uncertainty is acceptable. When sensor-based measurements are available, the dynamic state predictions can adjusted accordingly.

In at least some embodiments, the position control technique 100 includes three elements: the cost function 15 (used in block 106), a dynamic state predictor (e.g., BHA state predictor 14), and a predictor adaptation mechanism (block 104). As an example, suppose that the Finite Element based discrete system dynamics for a BHA (e.g., BHA 10) can be described as a general form:

$$X(k+1)=f_{BHA\ \ Mechanical}[X(k)]+f_{fluid\ \ damping}[X(k)]+f_{drill\ bits}[X(k)]+g[u(k)]+\text{Uncertainty}(k)$$

$$y(k+1)=h[X(k)], \qquad \text{Equation (1)}$$

where X is the state of the dynamic system, f, g, and h represent the linear or nonlinear functions that describe the dynamic equation, including the BHA finite element beam dynamics $f_{BHA}$, drilling fluid damping dynamics $f_{fluid\ damping}$ and also drill bits dynamics $f_{drill\ bits}$. The specific dynamic equations can be found in well-established literature. In Equation 1, y is the control output (the stabilizer relative position along the BHA $y=x_2$) and u is the control input command to the stabilizer actuator. Meanwhile, uncertainty (k) is the uncertainty expected for the dynamic model, k is the discrete time step, and k+1 is the next sampling time step following step k. Also, the state X is a vector consisting of multiple dynamic states of the BHA system. Typical states may include:

$$X(k) = \begin{bmatrix} \text{Stabilizer Moving Velocity} \\ \text{Stabilizer Position} \\ \text{Velocity of each finite element node} \\ \text{Angular velocity of each finite element node} \\ \text{Displacement of each finite element node} \\ \text{Angular displacement of each finite element node} \\ \text{Temperature} \\ \text{well pressure} \\ \text{Drill bit rotational speed} \\ \text{Bit bending angle} \\ \vdots \end{bmatrix}$$

At any time instant in the control process, future dynamic states can be predicted, and control signals for position adjustment assembly components can be determined to enable the optimal/desirable dynamic system states profile under a specified cost function.

As an example, suppose at sampling step k, a set of future actuator control commands denoted as: $u^k(k)$, $u^k(k+1)$, . . . , $u^k(k_final)$ are designed. Then with a BHA state predictor 15 given as follows, the future dynamic states can be estimated with measurement at step k→y(k) and the designed future control inputs. Here the future states estimated at step k are denoted as: $\hat{X}^k(k)$, $\hat{X}^k(k+1)$, . . . , $\hat{X}^k(k_final)$. The BHA state predictor 15 can be described as (L is a gain used for prediction adjustment or adaptation):

$$\hat{X}(k+1) = f_{BHA\ Mechanical}\left[\hat{X}(k)\right] + f_{fluid\ damping}\left[\hat{X}(k)\right] + f_{drill\ bits}\left[\hat{X}(k)\right] + g[u(k)] + L(k)\left(y(k) - h\left[\hat{X}(k)\right]\right)$$

$$\hat{X}(k+2) = f_{BHA\ Mechanical}\left[\hat{X}(k+1)\right] + f_{fluid\ damping}\left[\hat{X}(k+1)\right] + f_{drill\ bits}\left[\hat{X}(k+1)\right]$$

$$\vdots$$

$$\hat{X}(\text{k_final}) = f_{BHA\ Mechanical}\left[\hat{X}(\text{k_final}-1)\right] + f_{fluid\ damping}\left[\hat{X}(\text{k_final}-1)\right] + f_{drill\ bits}\left[\hat{X}(\text{k_final}-1)\right] + g[u(\text{k_final}-1)]$$

The uncertainty of the estimation at step k, Uncertainty (k), which may also be used in the cost function 15 to determine the control signals, can be calculated as:

$$P(k)=J_f\text{Uncertainty}(k-1)J_f^T+Q(k-1)$$

$$L(k)=P(k)J_h^T[J_hP(k)J_h+R(k)]^{-1}$$

$$\text{Uncertainty}(k)=[I-L(k)J_h]P(k), \qquad \text{Equation (2)}$$

where $J_f$ and $J_h$ are the Jacobian matrix the nonlinear function f and h, respectively. In Equation 2, Q is the dynamics system process noise covariance matrix, and R is the measurement noise covariance. Both Q and R are predetermined by off-line calibration or empirical estimation. To this end, based on the predicted future states, a new set of future control inputs $u^{k+1}(k+1)$, $u^{k+1}(k+2)$, . . . , $u^{k+1}(k_final)$ at sampling step k+1 can be designed by solving an optimization problem that minimizes a cost function (e.g., cost function 15) given as:

$$\min \sum_{k}^{k_final} W_1(BHA\ \text{Vibration Magnitude})^2 + W_2u(k)^2 + W_3(\text{Drill Bit Wear}) + W_4(\text{Desired Drilling Trajectory} - \text{Actual Drilling Path})^2 + W_5(\text{Uncertainty }(k))^2 + W_6(\text{Stabilizer Wear})^2 + W_7\left(\frac{1}{ROP}\right) + W_8(\text{Wellbore micro tortuosity}), \qquad \text{Equation (3)}$$

where $W_1$, $W_2$, $W_3$ . . . are weighting functions for each cost function term. The optimized control value $u^{k+1}(k+1)$ corresponds to an actuator control input at the sampling instant k+1. At the same time the states X(k+1) and control output y(k+1) can be measured or partially measured. Over time, the states measurement can be used to update the operations of BHA state predictor 14 (e.g., Equation 1), which calculates or updates future states. The control input $u^{k+2}(k+2)$ can be determined using the same optimization process. As desired, the weighting functions ($W_1$, $W_2$, $W_3$ . . . ) for the cost function 15 can be adapted in real-time as well. As an example, if the control emphasis is on vibration mitigation, then the value of $W_1$ may increase. As mentioned previously, the position control technique 100, including the embodiment represented by Equations 1-3, can be repeated to determine control signals for position adjustment assemblies 12A-12N until the end of the control cycle.

Another option for the position control technique 100 involves a robust control design technique for linear systems used to effectively reject disturbances and compensate for uncertainty in the system parameters. An example technique of such a robust design is $H_\infty$ loop shaping, which can be applied to non-linear systems (that is the case of intended dynamic system model) by identifying the operating point model of the non-linear system or finding an equivalent linear system. The goal here is to shape the frequency response transfer function of the system to fit the performance specifications and optimal performance.

Figure 5:
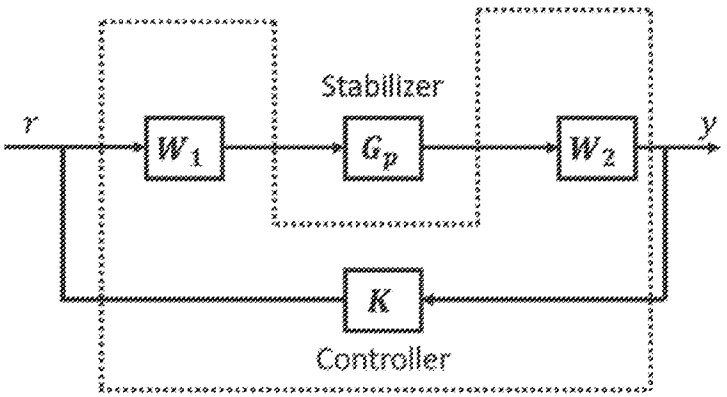
FIG. 5 is a block diagram showing an illustrative loop shaping control system to adjust position of a stabilizer or reamer.

One illustrative loop shaping control system is represented in FIG. 5. This is a two stage process. In the first stage, two weighting functions $W_1$ & $W_2$ (also known as pre-compensator and a post-compensator respectively) are chosen to provide with a nominal frequency response according to the desired performance specifications. $W_1$ is typically chosen such that the control system has suitable command tracking and disturbance rejection. In particular, $W_1$ may be chosen such that it exhibits high gain in low frequency regions. Further, $W_1$ may be shaped to attenuate disturbances from vibrations such as stick slip (typically low frequencies) and follow the commands. Meanwhile, $W_2$ is chosen such that it significantly attenuates the high frequency regions containing model uncertainties and sensor noise. In the second stage, this initial control design ($W_1$ and $W_2$) is further robustly stabilized with respect to the uncertainty bounds using the $H_\infty$ controller K. This iterative process is used to change the system closed-loop Eigen values such that the closed-loop system reaches the weighted transfer functions $W_1$ and $W_2$.

Figure 6:
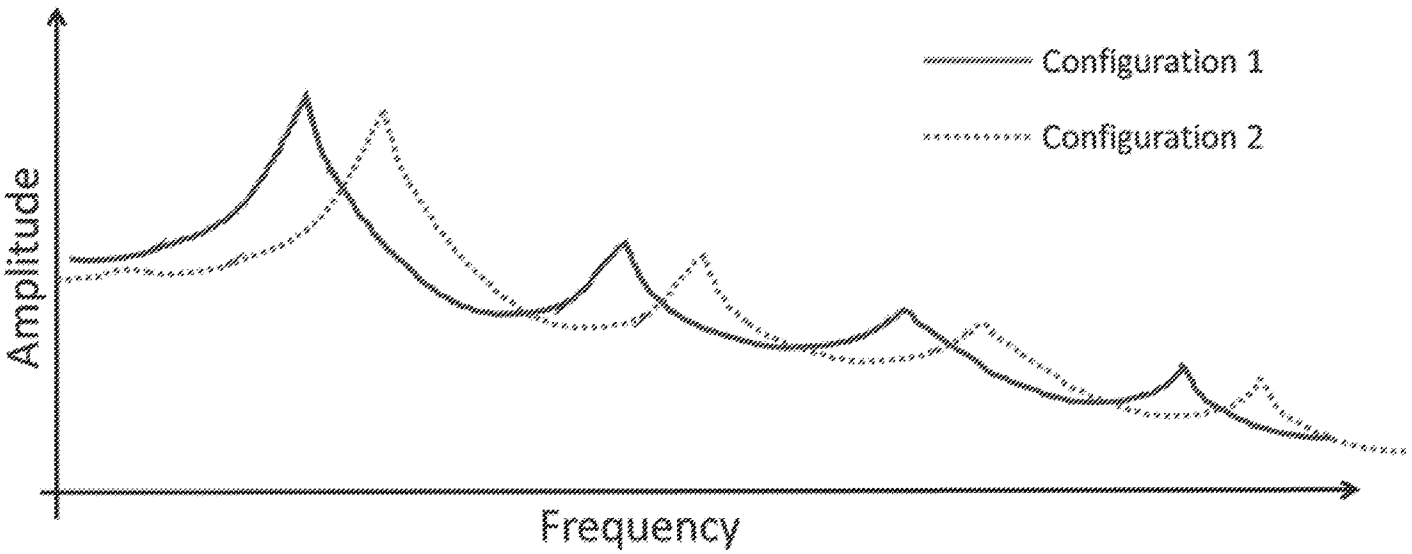
FIG. 6 is a graph showing amplitude as a function of frequency for different BHA configurations.

In at least some embodiments, the position reference point (i.e., the default position of each stabilizer or reamer 11A-11N) for a loop shaping control system can be automatically generated. For context, the location of each stabilizer or reamer 11A-11N along BHA 10 determines the natural frequencies of the BHA 10. Illustrative natural frequencies corresponding to different BHA configurations are represented in FIG. 6. If the forces at the bit excite these natural frequencies, then the resulting vibrations will oscillate at high amplitudes (known as resonance) leading to failure and breaking of the BHA. This observation leads to an intuitive solution to shift the natural frequencies of the BHA and this can be done by changing at least the axial position of one or more of the stabilizers or reamers 11A-11N. While changing the position of the stabilizers or reamers 11A-11N can be sufficient to ensure the BHA doesn't resonate, the default position of each of stabilizer or reamer 11A-11N is important and has a significant impact on the overall drilling dynamics. To automatically find out the optimal position reference points, a cost function as follows may be used:

$$\min\Big(W_1(BHA\ \text{Vibration Magnitude})^2 + W_2u(k)^2 + W_3(\text{Drill Bit Wear}) + W_4(\text{Trajectory error})^2 + W_5(\text{Uncertainty})^2 + W_6(\text{Stabilizer Wear})^2 + W_7\left(\frac{1}{ROP}\right) + W_8(\text{Wellbore micro tortuosity})\Big), \quad \text{Equation (3)}$$

where various constraints can be accounted for. Example constraints include, but are not limited to: 1) the position (mobility) range of a stabilizer or reamer; 2) the response time of position adjustment assembly components (e.g., actuators, etc.); and 3) the physical limits of position adjustment assembly components.

Figure 7:
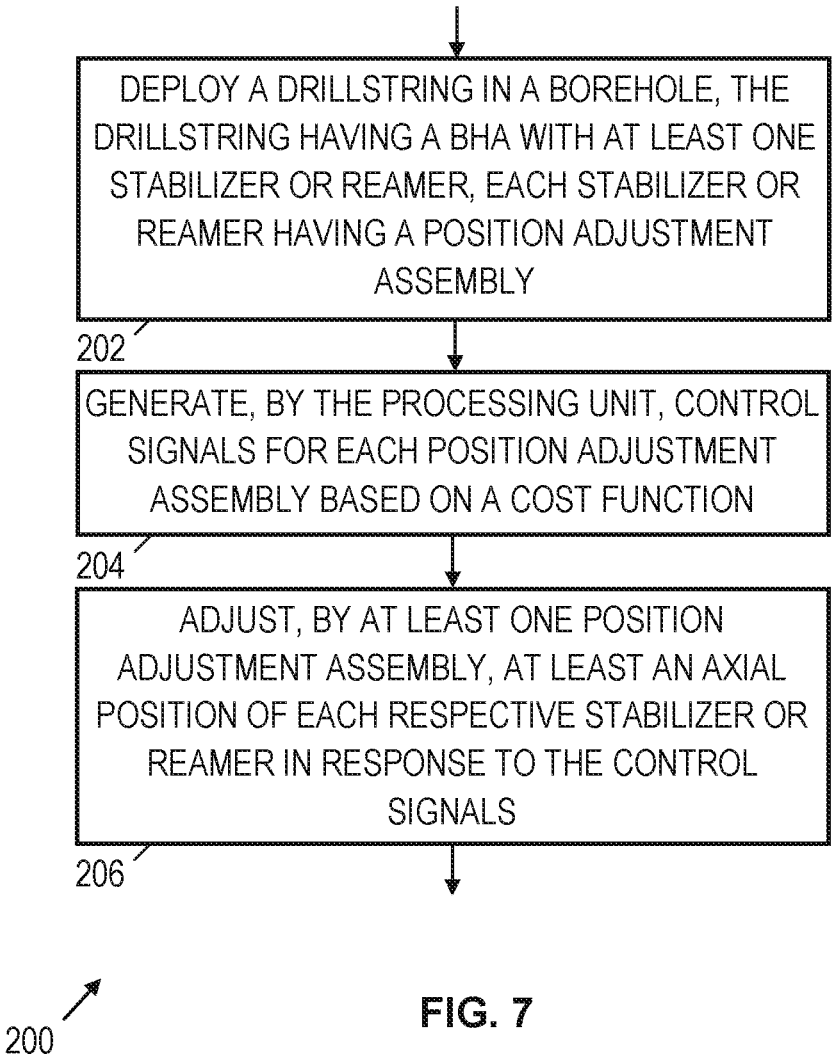
FIG. 7 is a flowchart showing an illustrative BHA stabilizer or reamer position adjustment method.

FIG. 7 is a flowchart showing an illustrative BHA stabilizer or reamer position adjustment method 200. At block 202 of method 200, a drillstring is deployed in a borehole, the drillstring having a BHA with at least one stabilizer or reamer (e.g., stabilizers or reamers 11A-11N), each stabilizer or reamer having a position adjustment assembly (e.g., position adjustment assemblies 12A-12N). At block 204, control signals for each position adjustment assembly is generated by the processing unit based on a cost function (e.g., cost function 15). In at least some embodiments, the cost function accounts for predicted BHA states and a position range for each respective stabilizer or reamer. The predicted BHA states may be obtained by a processing unit (e.g., processing unit 16 or processing unit 52) that applies the predicted BHA states and/or other values to the cost function. In different embodiments, the processing unit may perform operations to determine the predicted BHA states (e.g., using BHA state predictor 14) and/or may receive predicted BHA states from another source as described herein. At block 206, at least one position adjustment assembly adjusts a position of each respective stabilizer or reamer in response to the control signals.

The method 200 may be repeated for different time intervals to provide dynamic adjustment of BHA stabilizers or reamers. For different time intervals, the control strategy may vary. For some time intervals, it may be determined that no adjustments to the BHA stabilizers or reamers are needed. In such case, control signals are either not generated this time interval or "null" control signals are generated for this time interval. Further, the control scheme for adjusting the position of BHA stabilizers or reamers may be constrained to avoid unnecessary or undesirable adjustments. The cost function (e.g., cost function 15) can account for such constraints and allow for weighting different factors as described herein. As desired, the cost function can be updated over time based on learning algorithms, updates in the information available from sensors or operators, updates to the BHA, and/or other factors.

Embodiments disclosed herein include:

A: A system that comprises a drillstring with a BHA. The system also comprises at least one stabilizer or reamer integrated with the BHA, wherein each of the at least one stabilizer or reamer includes a position adjustment assembly. The system also includes a processing unit that provides control signals to each position adjustment assembly, wherein the control signals are based on a cost function.

B: A method that comprises deploying a drillstring in a borehole, the drillstring having a bottomhole assembly (BHA) with at least one stabilizer or reamer, each stabilizer or reamer having a position adjustment assembly. The method also includes generating, by the processing unit, control signals for each position adjustment assembly based on a cost function. The method also includes adjusting, by at least one position adjustment assembly, a position of each respective stabilizer or reamer in response to the control signals.

Each of the embodiments, A and B, may have one or more of the following additional elements in any combination. Element 1: wherein the cost function accounts for predicted BHA states and a position range for each stabilizer or reamer. Element 2: wherein each position adjustment assembly is configured to adjust at least an axial position of a respective stabilizer or reamer along the BHA. Element 3: wherein the at least one stabilizer comprises a plurality of axially-spaced stabilizers. Element 4: wherein the position adjustment assembly comprises a position lock/unlock component. Element 5: wherein the position adjustment assembly comprises an actuator component. Element 6: wherein the position adjustment assembly comprises a sliding track component or roller component. Element 7: wherein the cost function includes at least four of a vibration magnitude term, a stabilizer or reamer position term, a drill bit wear term, a trajectory error term, an uncertainty term, a stabilizer or reamer wear term, a rate of penetration term, and a borehole tortuosity term. Element 8: wherein the processing unit applies weights to at least some of the terms of the cost function. Element 9: wherein the processing unit adjusts at least some of the terms or term weights of the cost function over time. Element 10: further comprising a data storage in communication with the processing unit, wherein the data storage stores a look-up table (LUT) of values related to the cost function, and wherein the processing unit selects the control signals based at least in part on the LUT values. Element 11: wherein the processing unit is part of the BHA.

Element 12: further comprising obtaining, by a processing unit, predicted BHA states, wherein the cost function accounts for the predicted BHA states and a position range for each stabilizer or reamer. Element 13: wherein said adjusting comprises operating a lock/unlock component of the position adjustment assembly. Element 14: wherein said adjusting comprises operating an actuator component of the position adjustment assembly. Element 15: wherein the cost function includes at least four of a vibration magnitude term, a stabilizer or reamer position term, a drill bit wear term, a trajectory error term, an uncertainty term, a stabilizer or reamer wear term, a rate of penetration term, and a borehole tortuosity term. Element 16: further comprising adjusting at least some of the terms or term weights of the cost function over time. Element 17: further comprising applying the cost function to a time-domain optimization problem to select control signals for each position adjustment assembly. Element 18: further comprising applying the cost function to a frequency-domain optimization problem to select control signals for each position adjustment assembly.

Numerous other variations and modifications will become apparent to those skilled in the art once the above disclosure is fully appreciated. It is intended that the following claims be interpreted to embrace all such variations and modifications where applicable.

What is claimed is:

1. A system that comprises:

a drillstring with a bottomhole assembly (BHA);

at least one stabilizer or reamer integrated with the BHA, wherein each of the at least one stabilizer or reamer includes a position adjustment assembly; and a processing unit that provides control signals to each position adjustment assembly, wherein:

the control signals minimize a cost function; and finite element based discrete system dynamics for the BHA are described as:

$$X(k+1)=f_{BHA\ Mechanical}[X(k)]+f_{fluid\ damping}[X(k)]+f_{drill\ bits}[X(k)]+g[u(k)]+\text{Uncertainty}(k)$$

$$y(k+1)=h[X(k)]$$

where:

X is a vector consisting of multiple dynamic states of the system;

f, g, and h represent linear and non-linear functions that describe a dynamic equation, including BHA finite element beam dynamics $f_{BHA}$, drilling fluid damping dynamics $f_{fluid\ damping}$, and drill bits dynamics $f_{drill\ bits}$;

y is a control output (stabilizer relative position along the BHA $y=x_2$;

u is a control input command to a stabilizer actuator;

uncertainty(k) is an uncertainty expected a dynamic model;

k is a discrete time step; and k+1 is a next sampling time step following time step k.

2. The system of claim 1, wherein the cost function accounts for predicted BHA states and a position range for each stabilizer or reamer.

3. The system of claim 1, wherein each position adjustment assembly is configured to adjust at least an axial position of a respective stabilizer or reamer along the BHA.

4. The system of claim 1, wherein the at least one stabilizer comprises a plurality of axially-spaced stabilizers.

5. The system of claim 1, wherein the position adjustment assembly comprises a position lock/unlock component.

6. The system of claim 1, wherein the position adjustment assembly comprises an actuator component.

7. The system of claim 1, wherein the position adjustment assembly comprises a sliding track component or roller component.

8. The system of claim 1, wherein the cost function includes at least four of a vibration magnitude term, a stabilizer or reamer position term, a drill bit wear term, a trajectory error term, an uncertainty term, a stabilizer or reamer wear term, a rate of penetration term, and a borehole tortuosity term.

9. The system of claim 8, wherein the processing unit applies weights to at least some of the terms of the cost function.

10. The system of claim 8, wherein the processing unit adjusts at least some of the terms or term weights of the cost function over time.

11. The system of claim 1, further comprising a data storage in communication with the processing unit, wherein the data storage stores a look-up table (LUT) of values related to the cost function, and wherein the processing unit selects the control signals based at least in part on the LUT values.

12. The system according to claim 1, wherein the processing unit is part of the BHA.

13. A method that comprises:

deploying a drillstring in a borehole, the drillstring having a bottomhole assembly (BHA) with at least one stabilizer or reamer, each stabilizer or reamer having a position adjustment assembly;

generating, by a processing unit, control signals for each position adjustment assembly minimize a cost function; and adjusting, by at least one position adjustment assembly, a position of each respective stabilizer or reamer in response to the control signals; wherein finite element based discrete system dynamics for the BHA are described as:

$$X(k+1)=f_{BHA\ Mechanical}[X(k)]+f_{fluid\ damping}[X(k)]+f_{drill\ bits}[X(k)]+g[u(k)]+\text{Uncertainty}(k)$$

$$y(k+1)=h[X(k)]$$

where:

X is a vector consisting of multiple dynamic states of the system;

f, g, and h represent linear and non-linear functions that describe a dynamic equation, including BHA finite element beam dynamics $f_{BHA}$, drilling fluid damping dynamics $f_{fluid\ damping}$, and drill bits dynamics $f_{drill\ bits}$;

y is a control output (stabilizer relative position along the BHA $y=x_2$;

u is a control input command to a stabilizer actuator;

uncertainty(k) is an uncertainty expected a dynamic model;

k is a discrete time step; and k+1 is a next sampling time step following time step k.

14. The method of claim 13, further comprising obtaining, by a processing unit, predicted BHA states, wherein the cost function accounts for the predicted BHA states and a position range for each stabilizer or reamer.

15. The method of claim 13, wherein said adjusting comprises operating a lock/unlock component of the position adjustment assembly.

16. The method of claim 13, wherein said adjusting comprises operating an actuator component of the position adjustment assembly.

17. The method of claim 13, wherein the cost function includes at least four of a vibration magnitude term, a stabilizer or reamer position term, a drill bit wear term, a trajectory error term, an uncertainty term, a stabilizer or reamer wear term, a rate of penetration term, and a borehole tortuosity term.

18. The method of claim 17, further comprising adjusting at least some of the terms or term weights of the cost function over time.

19. The method according to claim 13, further comprising applying the cost function to a time-domain optimization problem to select control signals for each position adjustment assembly.

20. The method according to claim 13, further comprising applying the cost function to a frequency-domain optimization problem to select control signals for each position adjustment assembly.

* * * * *